US005222185A

United States Patent [19]

McCord, Jr.

[11] Patent Number: 5,222,185

[45] Date of Patent: Jun. 22, 1993

[54] PORTABLE WATER HEATER UTILIZING COMBINED FLUID-IN-CIRCUIT AND INDUCTION HEATING EFFECTS

[76] Inventor: Harry C. McCord, Jr., 6306 N. 500 W, Marion, Ind. 46952

[21] Appl. No.: 857,964

[22] Filed: Mar. 26, 1992

[51] Int. Cl.[5] ..... B42F 17/00

[52] U.S. Cl. ..... 392/314; 219/10.47; 219/10.51; 219/10.491; 392/318; 392/324; 392/338

[58] Field of Search ..... 392/311-338; 219/10.51, 10.49, 10.47

[56] References Cited

U.S. PATENT DOCUMENTS

| | | | |
|---|---|---|---|
| 760,280 | 5/1904 | Toennes | 392/313 |
| 1,025,281 | 5/1912 | Lawson | 392/313 |
| 1,358,982 | 11/1920 | Papini | 392/314 X |
| 1,360,437 | 11/1920 | Papini | 392/314 X |
| 1,362,356 | 12/1920 | Schneider | 392/318 |
| 1,366,752 | 1/1921 | Stephens | 392/313 |
| 1,406,100 | 2/1922 | Stephens | 392/313 |
| 1,433,388 | 10/1922 | Ledig | 392/313 X |
| 2,140,516 | 12/1938 | Cowan | 392/336 |
| 2,519,515 | 8/1950 | Turner | 392/324 |

*Primary Examiner*—Anthony Bartis
*Attorney, Agent, or Firm*—Woodard, Emhardt, Naughton, Moriarty & McNett

[57] ABSTRACT

A portable electric water heater has spaced concentrically disposed ferromagnetic electrodes defining an annular chamber for an electrically conductive liquid to be contained between the electrodes. The electrodes are encased in a housing having a liquid inlet and outlet and wired to pass an electric heating current between the electrodes and through the liquid therebetween to heat the liquid in the annular chamber. The liquid acts as a switch, breaking the heating current flow when no liquid is present in the annular chamber. An electromagnetic induction coil is disposed around one of the electrodes and has one of its leads connected to the electrode. The other induction coil lead and the other electrode are connected to a source of electric current. Completion of the electric circuit by introduction of a liquid between the electrodes also energizes the electromagnetic induction coil to further heat the fluid.

7 Claims, 4 Drawing Sheets

PORTABLE WATER HEATER UTILIZING COMBINED FLUID-IN-CIRCUIT AND INDUCTION HEATING EFFECTS

BACKGROUND OF THE INVENTION

This invention relates generally to devices for heating liquids, and more particularly to a portable electric device for heating relatively small amounts of liquid in the home or office. Alternative embodiments of the present invention are suitable for use as a vaporizer, or for installation directly in a water line.

Traditional heaters use either of two methods to heat liquids. Some heaters use a flame fueled by gas or some other combustible substance to heat a vessel containing the liquid and, by conduction, the liquid contained therein. These flame-type heaters heat relatively quickly and may allow for some control over the speed and degree of the heating by increasing or decreasing the size of the flame. Other heaters pass an electric current through a resistive element which is in or near the liquid. The electrical resistance causes the heating element to heat, subsequently heating the liquid. Electric heaters, while safer to operate than flame-type heaters, typically provide the user with diminished control.

Both of the aforementioned methods have disadvantages for heating relatively small amounts of liquid in the home or office. For example, the flame method, while heating quickly, presents obvious dangers to the user and his environment by the use of an open flame. For this reason flame-type heaters should never be left unattended and require constant monitoring during even casual use. In addition, an external source of fuel is required, typically causing a flame-type heater to be bulky and less aesthetically pleasing than electric designs. This is especially true if the heater is adapted for extended use. Similarly, the inconvenience of monitoring fuel consumption and replacing fuel containers is a significant disadvantage of portable heaters which use a flame.

Traditional electric heaters do not present the same disadvantages as combustion-type heaters, but instead present alternative problems. In particular, traditional electric heaters are slow to heat, making rapid liquid heating of even small amounts of liquid nearly impossible. Similarly, the heating element, once heated, remains hot until the heat has dissipated into the environment, causing the liquid to continue to heat even after the heater has been turned off.

The present invention combines the safety of an electric heater with the rapid heating and instantaneous shut-off of a combustion flame device.

SUMMARY OF THE INVENTION

In one embodiment of the present invention, a device for heating liquids is provided which comprises first and second elongated electrodes, each having a terminal attached thereto for connection to a source of electric current. The device includes a housing having means for supporting the two electrodes in spaced apart relation relative to each other, and means for defining a heating chamber between the first and second electrodes so that a liquid can circulate between the electrodes. Means are provided for flowing liquid through the housing into the heating chamber, which means can include a number of inlet apertures defined in the housing adjacent the bottom end of the electrodes. The housing further defines an outlet aperture adjacent the top end of the electrodes which is concentric with and communicates directly to the heating chamber. When the first and second electrodes are connected to the source of electric current the liquid within the heating chamber completes an electric circuit between the electrodes and is subsequently heated to steam within the chamber. The steam escapes through the outlet aperture in the housing.

In a further embodiment of the invention, a device for heating liquids comprises a first cylindrical electrode composed of a ferromagnetic electrically conductive material and a second electrode having a terminal for connection to a source of electric current. The device includes a housing having means for supporting the electrodes in spaced apart concentric relation relative to each other to define a heating chamber between the two electrodes. Means are provided for flowing liquid through the housing to circulate between the electrodes in the heating chamber. In this embodiment, an electromagnetic induction coil surrounds the first cylindrical electrode. The electromagnetic induction coil has an input terminal for connection to a source of electric current and an output terminal electrically conductively connected to the first electrode. When the first and second electrodes are connected to a source of electric current the liquid within said heating chamber completes an electric circuit between said electrodes, thereby energizing the electromagnetic induction coil. It has been discovered that the combination of the electromagnetic induction coil with the electrodes decreases the amount of time required to heat the water in the heating chamber to steam.

In one specific embodiment, the electromagnetic induction coil is a toroidal electromagnet concentrically disposed about the electrode. Alternatively, the electromagnetic induction coil can be a coil winding about a predetermined length of the cylindrical first electrode. In each instance, the electromagnetic induction coil is preferably insulated.

DESCRIPTION OF THE PREFERRED EMBODIMENTS

Figure 1:
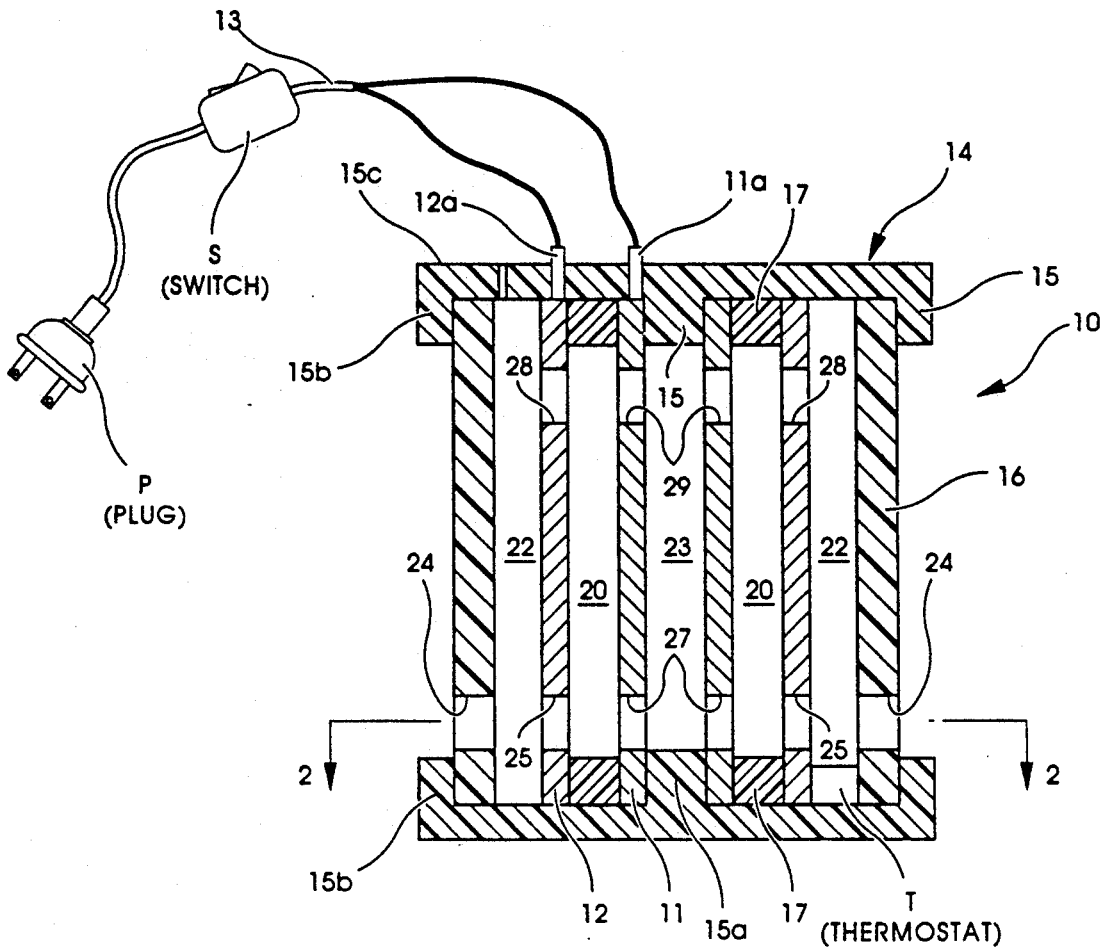
FIG. 1 is a side cross-sectional view of one embodiment of the portable heater for use in heating liquid in a container.

For the purposes of promoting an understanding of the principles and operation of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to those skilled in the art to which the invention pertains.

Figure 2:
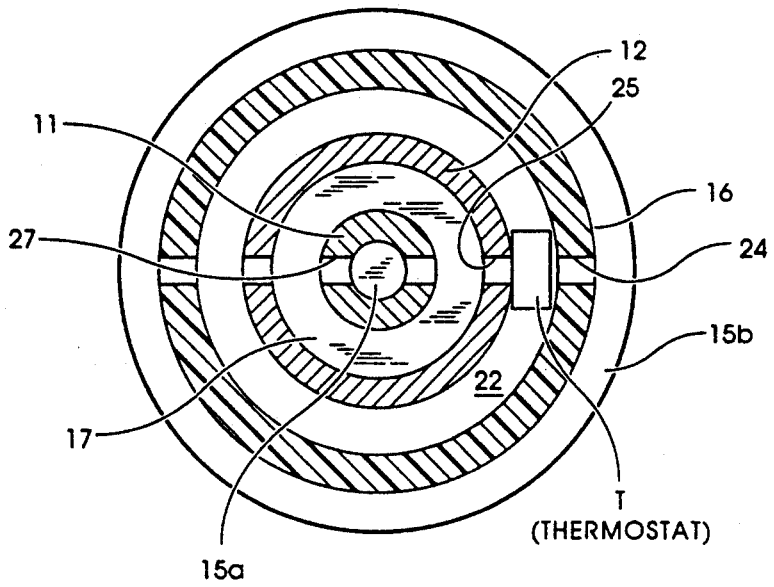
FIG. 2 is a top cross-sectional view of the embodiment of FIG. 1, taken along line 2—2 in FIG. 1 as viewed in the direction of the arrows.

Referring now to the drawings, FIGS. 1 and 2 show the basic components of the portable water heater 10. In the preferred embodiment, a first cylindrical electrode 11 is concentrically disposed within a second cylindrical electrode 12 defining an annular chamber 20 for a liquid to flow between. Each electrode includes a terminal 11*a* and 12*a*, respectively, attached at one end. Wires 13 are attached to terminals 11*a* and 12*a*, as part of a plug P and switch S configuration for electrically connecting the portable water heater 10 to a source of household current.

The electrodes 11 and 12 are contained within a housing 14 which is constructed of a non-conducting or insulating material to protect the user from electric shocks. The housing 14 includes identical end pieces 15 which include a central boss 15*a* for locating the inner cylindrical electrode 11. At least one of the end pieces 15 includes openings for the terminals 11*a* and 12*a* to pass through for connection to the wires 13. The housing 14 also includes an outer cylindrical sleeve 16 which is sealed to circumferential flanges 15*b* of end pieces 15 to form an enclosure about the electrodes. The components of the housing 14 are preferably constructed of either a plastic, such as neoprene or vinyl, or a ceramic material, such as glass, provided the material can withstand high temperatures as well as normal household traumas without breaking.

In the preferred embodiment, a pair of insulating rings 17 are disposed between and at opposite ends of the electrodes 11 and 12 to establish a particular spacing between the electrode surfaces. The radial thickness of the insulating rings determines the electrode spacing (as well as the diameter of the outer electrode 12), which may vary according to the particular application for the portable water heater 10. Preferably, the insulating rings are composed of rubber or another highly insulative material. The insulating rings 17 can be affixed to the housing end pieces 15 in a known manner, such as by an adhesive.

The portable water heater 10 of the present embodiment is adapted to heat small amounts of liquid contained within a cup, such as to heat water for making hot tea. A number of apertures 24 are provided in the outer sleeve 16 of the housing 14 to admit water within the housing enclosure when the portable heater is immersed in a cup of liquid. Similar apertures 25 and 27 are provided in the outer electrode 12 and inner electrode 11, respectively. These apertures permit liquid to fill the annular chamber 20 between the electrodes, as well as the outer annular chamber 22 between the outer electrode 12 and the housing, and the inner chamber 23 within the inner electrode 11. A number of vent orifices 15*c* can be provided in the upper end piece 15 to vent gas, such as air, from the chambers. The outer chamber 22 and inner chamber 23 can operate as reservoirs for liquid to mix with liquid heated by the electrodes 11 and 12. The outer electrodes 12 and 11 also include apertures 28 and 29, respectively, at the upper ends of the electrodes to permit liquid to spill over the electrodes into the various chambers within the housing enclosure.

In operation, liquid enters the portable heater 10 through the apertures 24 in housing 14. The liquid flows through apertures 25 and 27 to fill chambers 22 and 23, and more particularly, annular chamber 20 between the electrode surfaces. The liquid in annular chamber 20 completes an electric circuit between electrodes 11 and 12, allowing current to pass therethrough. The current passing through the liquid heats the liquid quickly—how quickly depends upon the amperage of the current provided to the portable heater 10. When connected to a standard 110 V household outlet, one ounce of water can be heated to 115 degrees (Fahrenheit) in approximately 6 seconds.

The apertures 28 and 29 at the upper end of the electrodes permits water heated within the annular chamber 20 to spill over into the reservoirs 22 and 23 to mix with cooler liquid. Water heated to boiling in the annular chamber 20 is displaced by cooler water drawn through the apertures 25 and 27 at the lower end of the electodes as the liquid seeks its own level within the housing 14. It is understood that the apertures 27 and 29 through the inner electrode 11, and the inner reservoir chamber 23, are not required. However, liquid within the inner chamber 23 can have the beneficial effect of providing cooling to the inner electrode 11, which will necessarily heat somewhat as current flows through the electrode.

It should be appreciated that the present design comprises a heater with an automatic shut-off if the liquid is removed or boiled away. The liquid entrained in annular chamber 20 acts as a switch to open and close the electric circuit between the electrodes 11 and 12. When no liquid remains between the two electrodes of the heater the circuit is interrupted and the heater immediately stops.

The spacing between the electrodes, and between the electrodes and the housing, will help define the speed with which the liquid in the cup will heat. In general, the distance between the the electrodes must be great enough to prevent the liquid contained therein from rapidly boiling away, while still small enough to allow the current passing therethrough to quickly heat the liquid. A thermostat T may be situated within the housing 14 and suitably wired to switch S to stop the flow of current to the electrodes when a set temperature is reached. This thermostat T can prevent the portable heater 10 from becoming too hot, as might happen if the heater short circuited, or the thermostat T can be set by the user to heat liquids to a desired temperature.

Although the most likely uses of the heater will be to heat cups of coffee, tea, water, etc., the device can be used to heat any liquid which is capable of transferring an electrical charge. Similarly, although any electrical conductor may be used for constructing the electrodes, the practical applications of the invention dictate that care must be taken in selecting electrodes to assure that an electrochemical reaction does not occur between the electrodes and the fluid. For general household use, the preferred electrodes are constructed of nickel or a nickel alloy, such as Nichrome or nickel-silver, to avoid reactions and to prevent corrosion from accumulating on the electrode surfaces.

While FIGS. 1 and 2 illustrate only two sets of diametrally aligned apertures 24, 25 and 27, a greater number of apertures may be provided. For instance, a plurality of apertures 24 may be spaced at equal angular increments around the circumference of the sleeve 16. Likewise, the number of apertures 25, 27, 28 and 29 may be similarly increased.

Figure 3:
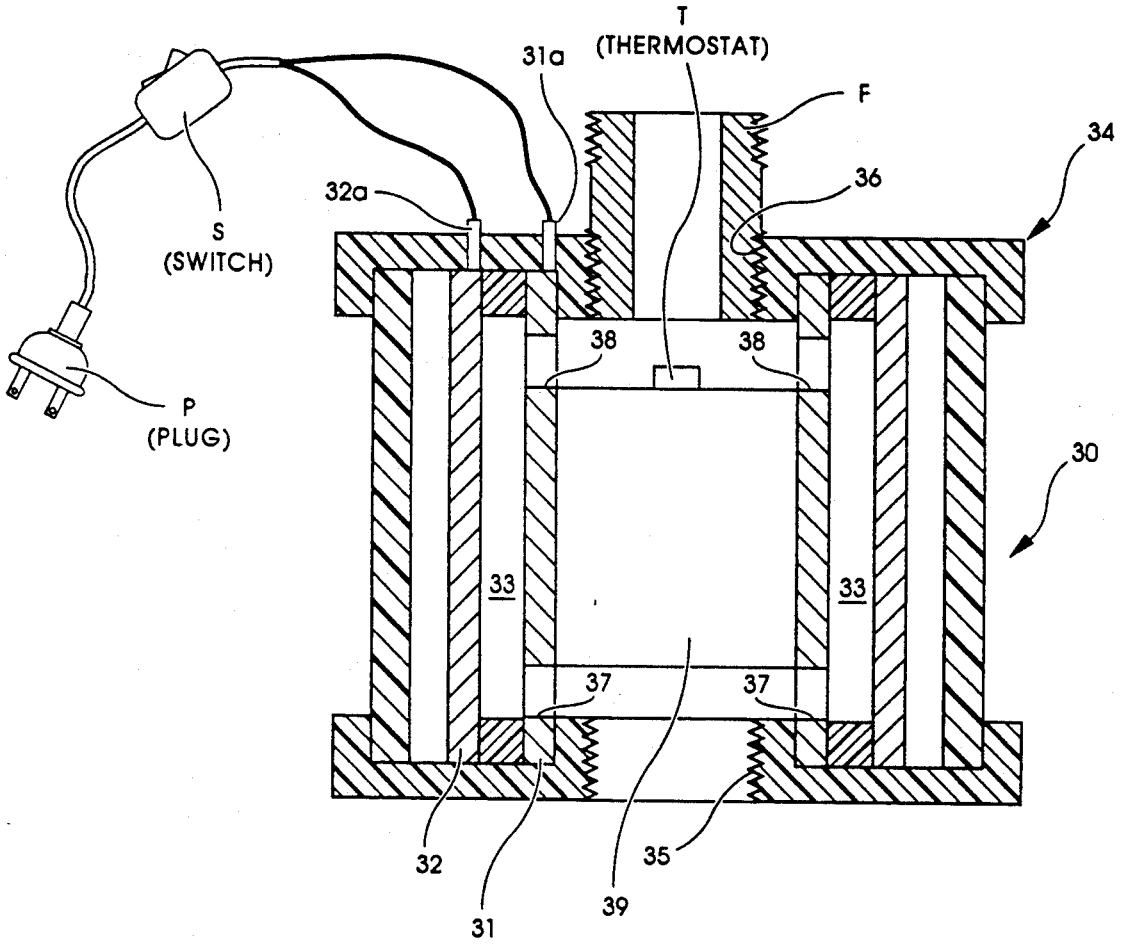
FIG. 3 is a side cross-sectional view of one embodiment of the portable heater adapted for installation directly in a water line.

An alternative embodiment of the present invention, as shown in in FIG. 3, is a heater 30 for use directly in a water line for in-line heating. This embodiment also employs a first cylindrical electrode 31 concentrically disposed within a second cylindrical electrode 32 with an annular chamber 33 for liquid to flow therebetween. In this in-line embodiment the housing 34 can be similar in construction to the housing 14 of the prior embodiment; however, the housing 34 includes only two apertures 35 and 36 situated at the opposite ends of the housing so that liquid can flow directly through the heater 30.

In this in-line embodiment, the outer electrode 32 has no apertures and may, therefore, be situated directly adjacent the housing outer wall. The inner electrode 31 includes lower and upper apertures, 37 and 38, respectively, to provide a flow path for liquid passing through the annular chamber 33. A plug 39 is preferably fixed within the inner electrode 31 so that the liquid must flow around the electrode 31 and through the annular chamber 33 between the electrode surfaces.

The housing apertures 35 and 36 are threaded so that the heater is readily installed directly in a water line. An externally threaded fitting F can be provided at one end to mate with internal threads of a water pipe or hose fitting. As in the previous embodiment, the electrodes 31 and 32 can be connected, through a switch S and plug P to a source of electric current. A thermostat T can be disposed adjacent the liquid exit opening 36 for controlling the temperature of the liquid passing through the heater 30.

Figure 4:
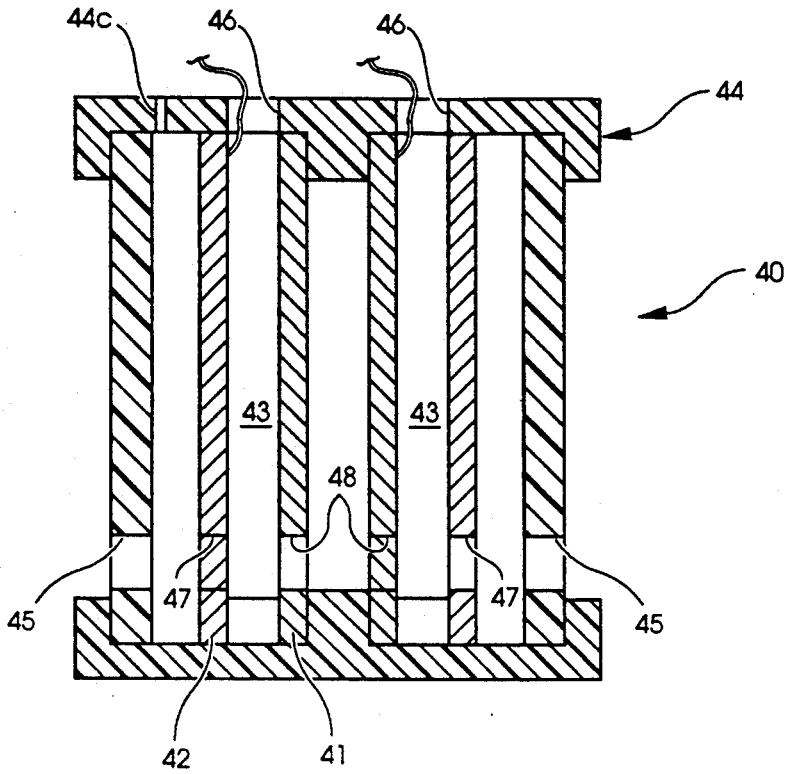
FIG. 4 is a side cross-sectional view of one embodiment of the portable heater adapted for use as a vaporizer.

A third alternative embodiment, wherein the invention is used as a vaporizer, is shown in FIG. 4. As is clear from the foregoing description, steam can easily be generated by allowing the liquid to be heated to its boiling point. The vaporizer 40 generates steam using a first cylindrical electrode 41 concentrically disposed within a second cylindrical electrode 42 with an annular chamber 43 for liquid therebetween. As should be clear, the liquid within annular chamber 43 completes an electric circuit between the concentric electrodes 41 and 42.

A housing 44 supports the electrodes and is configured similar to the housing 14 of the embodiment of FIG. 1. The housing 44 includes lower apertures 45, similar to apertures 24, which admits water into the vaporizer 40. The housing also includes a vent orifice 44*c* and a number of apertures 46 at the top of the vaporizer that communicate directly with the annular chamber 43 between the electrodes. Apertures 47 in the outer electrode 42 permit water to fill the annular chamber 43. Apertures 48 may optionally be formed in the inner electrode 41.

The vaporizer 40 is intended to be immersed in a container of water, with the apertures 46 exposed above the surface of the water. Water passing through housing apertures 45 and electrode apertures 47 seeks its own level within the housing enclosure. Water between the electrodes 41 and 42 completes the electric circuit and is heated to boiling. As the water boils off as steam, the water level within annular chamber 43 gradually decreases until it falls below the level of the apertures 47. The electric circuit is then broken and the vaporizer automatically shuts off.

Figure 5:
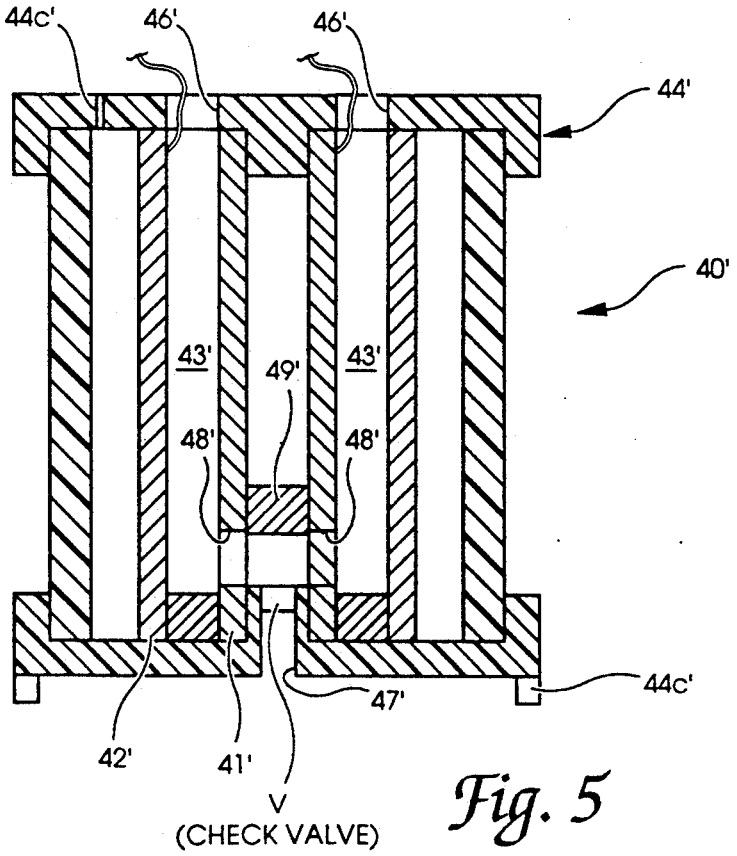
FIG. 5 is a side cross-sectional view of a variation of the embodiment in FIG. 4 adapted for use as a vaporizer.

An alternative vaporizer 40′ is shown in FIG. 5 that is adapted to incorporate a one-way check valve. The vaporizer 40′ includes a housing 44′, similar to housing 44 except that the side apertures 47 have been replaced by a single central aperture 47′ at the base of the housing. Legs 44*c*′ are provided to offset the aperture 47′ from the container of liquid within which the vaporizer 40′ is immersed. The outer electrode 42′ is solid and the core of inner electrode 41′ is closed by plug 49′ so that water passes through aperture 47′ and apertures 48′ into the annular chamber 43′ for heating.

A one-way check valve V is disposed within aperture 47′ to control the flow of liquid into the vaporizer 40′. The pressure of water outside the vaporizer 40′ opens the check valve V to admit water into annular chamber 43′. However, as the water fills the chamber 43′ it is heated and steam is generated, thereby increasing the pressure within the vaporizer 40′. As the vapor pressure increases, the check valve V closes to stop water from entering through aperture 47′. Once the water within annular chamber 43′ has boiled off as steam, the water pressure exceeds the internal pressure of the vaporizer 40′ and the valve V opens.

Alternative placement of housing apertures or electrode apertures will alter the flow path of the liquid through the heater and will therefore affect the characteristics and performance of the heater. As long as the aperture arrangements permit liquid to pass through the annular chamber between electrodes, the basic principles and design of the invention remain unchanged. Also, it is clear that a large number of cosmetic changes may be made to adapt the heater to a particular use without changing the basic design. For instance, while the electrodes and housing of the illustrated embodiments have a circular cross-section, other cross-sectional shapes may be used, such as rectangular.

Figure 6:
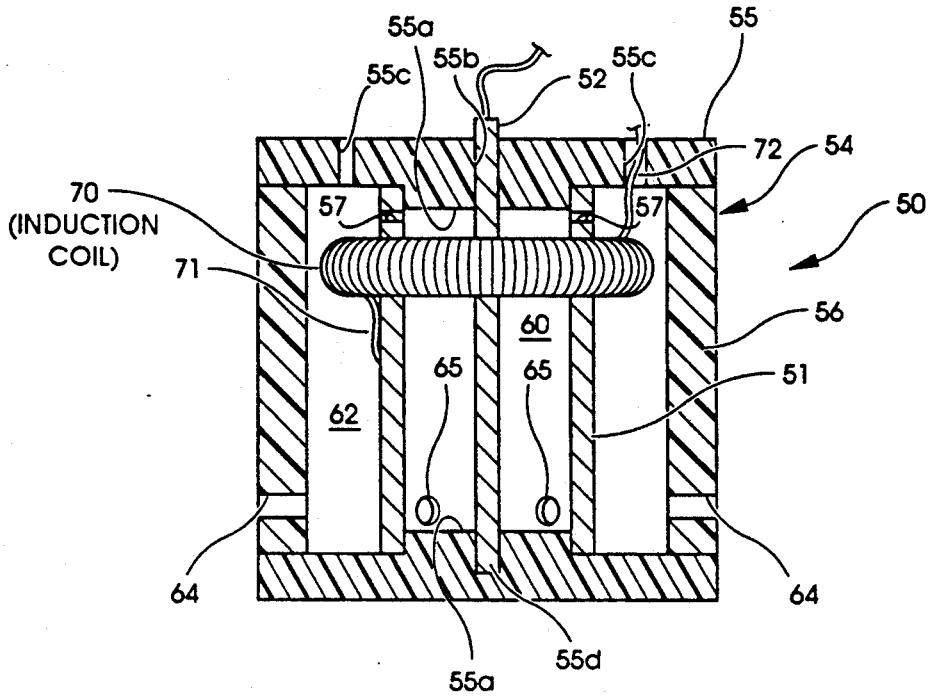
FIG. 6 is a side cross-sectional view of a further embodiment of the portable heater of the present invention.
Figure 7:
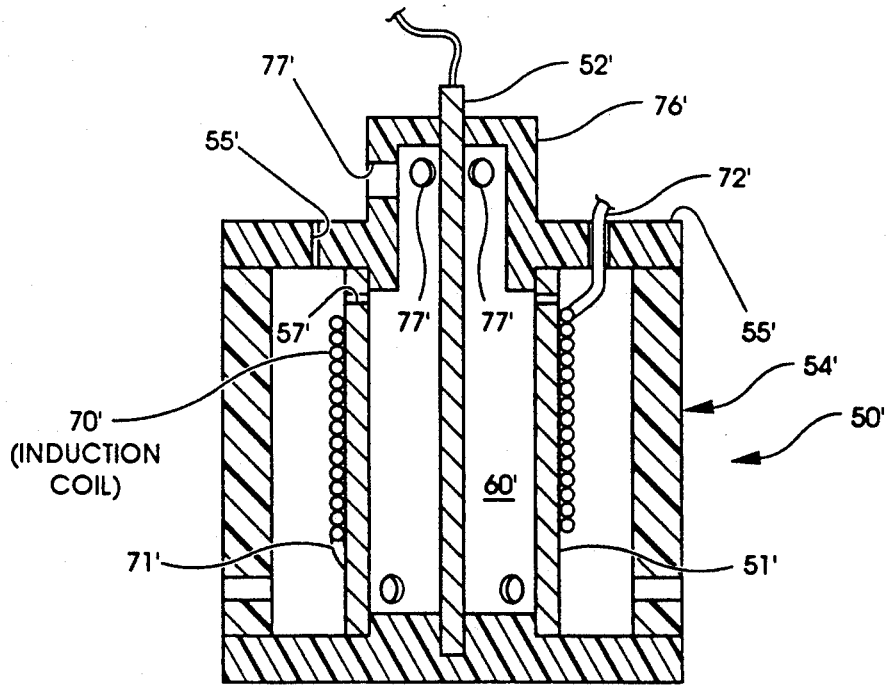
FIG. 7 is a side cross-sectional view of a variation of the embodiment shown in FIG. 6.

A further embodiment of the invention is shown in FIGS. 6 and 7 which implements the features of the prior embodiments, augmented by a electromagnetic induction coil to help heat the water by "magnetic induction." Referring first to FIG. 6, a portable water heater 50 includes a first cylindrical electrode 51 which is concentrically disposed about a second electrode 52. In this embodiment, the first electrode 51 is a ferromagnetic electrically conductive tube, such as a steel tube or pipe. The second electrode 52 is simply a conductive rod in a specific embodiment.

The two electrodes 51 and 52 are contained within a housing 54 which is constructed of a non-conducting or insulating material. The housing 54 includes end pieces 55 which are substantially identical, at least in basic construction. The top end piece 55 includes an opening 55*b* through which the electrode 52 passes, and vent openings 55*c* to vent gas such as air, from the interior of the housing 54. The lower end piece 55 includes a recess 55*d* aligned with the bore 55*b*, within which the electrode 52 rests. Both end pieces 55 include a central boss 55*a* projecting inwardly therefrom which are used to locate the cylindrical electrode 51. The two end pieces 55 can be affixed to a cylindrical sleeve 56, such as by epoxy or welding. The components of the housing 54 are preferably constructed from either a plastic material, such as neoprene or vinyl, or a ceramic material, such as glass, provided the material can withstand high temperatures.

The portable heater 50 of the present embodiment is adapted to heat liquid within a separate container. Thus, a number of apertures 64 are provided in the outer cylindrical sleeve 56 to allow ingress of liquid into the housing 54. The vents 55*c* allow gas to escape from the housing as liquid enters the annular reservoir 62 situated between the sleeve 56 and the cylindrical electrode 51. The electrode 51 itself also includes a number of apertures 65 therethrough to allow ingress of liquid into the central cavity 60 within cylindrical electrode 51. Thus, as with the portable heaters of the prior embodiments, the chambers 60 and reservoir 62 operate as reservoirs for liquid which is to be heated by way of the electrodes 51 and 52. Electrode 51 also preferably includes vent openings 57 near the top of the electrode. The openings 57 allow gas, such as steam, to escape from the heating chamber 60. Possibly more importantly the openings 57 allow the liquid to circulate between the chamber 60 and the reservoir 62.

In a deviation from the portable heaters of the previous embodiments, the portable heater 50 of the embodiment of FIG. 6 includes an electromagnetic induction coil, such as the toroidal coil 70. The output end of the toroidal coil 70 is electrically connected to the cylindrical electrode 51, such as by securing an electrically conductive weldment 71. The input lead 72 to the toroidal coil 70 extends through one of the vent orifices 55c and is connected along with the second electrode 52, to a source of AC current, as described in connection with the plug P and switch S shown in FIG. 1.

As in the portable heaters of the previous embodiments, the portable heater 50 is inoperative unless and until liquid is introduced into the housing 54 and particularly between the two electrodes 51 and 52. With the liquid in place, the electrical cicuit is completed between the electrodes thereby energizing not only the electrodes but the electromagnetic induction coil 70 when the coil 70 is energized, a magnetic circuit is formed which includes the ferromagnetic electrode 51. It has been discovered that application of an electromagnetic field heats the liquid more quickly than if the two electrodes were used alone.

In a variation on the electromagnetic coil embodiments shown in FIG. 6, a modified portable heater 50' is depicted in FIG. 7. It is understood that this modified portable heater 50' is substantially similar to the heater 50 shown in FIG. 6, with the exception of the magnetic coil. In this embodiment, the portable heater 50' includes a typical electromagnetic coil winding 70' formed by a single wire continuously wound around the cylindrical electrode 51'. The output end of the coil winding 70' is electrically conductively affixed to the cylindrical electrode 51' such as by weldment 71'. The input end 72' of the coil 70', extends through one of the vent orifices in the housing 54'. Both the rod electrode 52' and magnetic coil input end 72' are connected to an AC source to energize the electric and magnetic circuit of this embodiment. The number of coils in the coil winding 70' can be varied depending upon the magnitude of the input current and the heating requirements for the device.

Since the coil windings 70' will be immersed in liquid, it is important that the windings be insulated with a waterproof material. For instance, the wire making up the winding could be an insulated wire. Alternatively, the completed winding 70' could be sealed with a potting material. The toroidal coil 70 of the embodiment of FIG. 6 is also preferably liquid insulated.

The embodiment of FIG. 7 is further varied from the device in FIG. 6 in the construction of the upper end piece 55'. In particular, the end piece 55' includes a dome 76' extending upward from the housing 54'. The dome includes a number of large openings 77' therethrough which are provided to allow steam and gas to escape from the chamber 60'. This configuration allows the device 50' to be used as a vaporizer, for example.

It should be clear that while the invention has been illustrated and described in detail in the foregoing drawings and descriptions, the same are to be considered illustrative and not restrictive in character, it being understood that only the preferred embodiments have been shown and described, and that all changes and modifications that come within the spirit of the invention are desired to be protected.

What I claim is:

1. A device for heating liquids, comprising:
a first cylindrical electrode composed of a ferromagnetic electrically conductive material;
a second electrode having a terminal for connection to a source of electric current;
a housing having:
means for supporting said electrodes in spaced apart concentric relation; and
means for defining a heating chamber between said first and second electrodes so that a liquid can circulate between said electrodes;
electromagnetic induction coil means surrounding said first cylindrical electrode, said electromagnetic induction coil means having an input terminal for connection to a source of electric current, and an output terminal electrically conductively connected to said first cylindrical electrode; and
means for flowing liquid through said housing into said heating chamber, whereby when said first and second electrode terminals are connected to the source of electric current the liquid within said heating chamber completes an electric circuit between said electrodes to energize said (electromagnetic) induction coil means to cause heating of said first electrode and the liquid by electrical induction.

2. The device of claim 1 wherein said electromagnetic induction coil means comprises a toroidal electromagnet.

3. The device of claim 1 wherein said electromagnetic induction coil means comprises a coil winding wound about a predetermined length of said cylindrical first electrode.

4. The device for heating liquids of claim 1 wherein said first electrode encircles said second electrode.

5. The device for heating liquids of claim 1 wherein:
said housing includes means for providing a reservoir exterior to said electrodes; and
said means for flowing liquid includes means for flowing liquid between said heating chamber and said reservoir.

6. The device for heating liquids of claim 5, wherein said means for flowing liquid includes a number of apertures defined in said first electrode to allow liquid to pass therethrough into said heating chamber.

7. The device for heating liquids of claim 5, wherein said housing includes vent means in communication with said heat chamber for venting gas from said chamber.

* * * * *